US009834955B2

(12) United States Patent
Ludwig et al.

(10) Patent No.: US 9,834,955 B2
(45) Date of Patent: Dec. 5, 2017

(54) INSTALLATION BODY FOR DOOR AND/OR WINDOW HANDLES

(71) Applicant: HOPPE AG, Stadtallendorf (DE)

(72) Inventors: Manfred Ludwig, Weimar (DE); Matthias Kleis, Schwalmstadt (DE)

(73) Assignee: HOPPE AG, Stadtallendorf (DE)

( * ) Notice: Subject to any disclaimer, the term of this patent is extended or adjusted under 35 U.S.C. 154(b) by 419 days.

(21) Appl. No.: 14/658,122

(22) Filed: Mar. 13, 2015

(65) Prior Publication Data

US 2015/0308150 A1 Oct. 29, 2015

(30) Foreign Application Priority Data

Mar. 26, 2014 (DE) ..... 10 2014 104 271

(51) Int. Cl.

| | |
|---|---|
| ***E05B 3/00*** | (2006.01) |
| ***E05B 3/08*** | (2006.01) |
| ***E05B 3/06*** | (2006.01) |
| ***E05B 15/00*** | (2006.01) |

(52) U.S. Cl.

CPC ..... *E05B 3/08* (2013.01); *E05B 3/065* (2013.01); *E05B 15/006* (2013.01); *E05B 2015/0066* (2013.01)

(58) Field of Classification Search

CPC . Y10T 292/57; Y10T 70/5832; Y10T 292/85; Y10T 16/458; Y10T 292/82; Y10T 292/88; Y10T 70/5796; Y10T 292/14; E05B 1/0007; E05B 3/04

USPC ..... 292/336.3

See application file for complete search history.

(56) References Cited

U.S. PATENT DOCUMENTS 1,549,060 A * 8/1925 Burton ..... E05B 3/00 292/348
3,210,976 A * 10/1965 Best ..... E05B 55/005 292/356
3,261,630 A * 7/1966 Chew ..... E05B 63/18 292/169.18

(Continued)

FOREIGN PATENT DOCUMENTS

DE 8326076 U1 12/1983
DE 9319981 U1 4/1995

(Continued)

*Primary Examiner* — Mark Williams
(74) *Attorney, Agent, or Firm* — Reinhart Boerner Van Deuren P.C.

(57) ABSTRACT

An installation body used as an axially fixed and rotatable receptacle for a handle. The handle consist of a circumferential engagement groove in a neck section of the handle that is in contact with the installation body. The installation body is composed of a base body with a passage opening aligned centrally with an axis (D), a guide bushing for the neck section of the handle, whereas the guide bushing is arranged inside the passage opening of the base body and locking mechanism, which fixates the handle inside base body in a releasable manner. The locking mechanism uses locking balls, which are adjustable arranged radially in the direction of the axis inside the guide bushing. The latter is positioner the passage opening of the base body in a direction (A) in an adjustable manner, wherein the guide bushing, or the base body, has a circumferential inclined surface that is acted upon by a pressure spring the direction (A).

20 Claims, 3 Drawing Sheets

(56) References Cited

U.S. PATENT DOCUMENTS

| | | | | |
|---|---|---|---|---|
| 4,460,204 | A * | 7/1984 | Olsen | E05B 3/06 16/412 |
| 2010/0263419 | A1 * | 10/2010 | Calleberg | E05B 47/0011 70/277 |
| 2013/0015671 | A1 * | 1/2013 | Calleberg | E05B 47/0692 292/144 |
| 2013/0015672 | A1 * | 1/2013 | Nadgouda | E05B 13/005 292/224 |

FOREIGN PATENT DOCUMENTS

| | | |
|---|---|---|
| DE | 29801858 | 5/1998 |
| DE | 102011112095 | 3/2013 |
| EP | 0628680 | 9/1996 |
| EP | 1201850 A1 | 5/2002 |
| EP | 1022413 | 3/2003 |

* cited by examiner

INSTALLATION BODY FOR DOOR AND/OR WINDOW HANDLES

BACKGROUND OF THE INVENTION

Field of the Invention

The invention relates to an installation body for door and/or window handles.

The mounting of handles on doors or windows is often considered problematic due to the fact that the handle in question is often already connected to an installation body in an axially fixed and rotatable manner from the factory, for example by means of a crimp, by riveting, or by using a locking ring. Especially with regard to rosette fittings, the handle is often positioned in front of the screws to be tightened when the stop body is positioned on a door leaf or window sash, which can only be accessed if the handle is pivoted to the side when tightening the screws or by placing the corresponding tool at an oblique angle. This attachment process can thus be considered as cumbersome and inconvenient. Another disadvantage is that the preassembled handles take up a lot of space inside the packaging, which has unfavorable effects on shipping and warehousing costs. The latter is especially problematic if a number of different handles are intended for various stop bodies. Due to the fact that a preassembled handle cannot be provided with an arbitrary choice of stop bodies or door plates, the proper combinations have to be kept in stock.

In order to avoid these disadvantages and problems, a generally known workaround in accordance with the current state of the art is characterized by designing the handle and installation body to be separate and to provide a locking device between the aforementioned components, which allow for an on-site combination of the handle and installation body. It is thereby possible to first install the installation body on the door or window without requiring installation of the handle and to provide it with an optional covering cap. After that, the handle, which is fitted with a circumferential engagement groove on the end, is inserted into the mounting plate up to the point where one or multiple locking elements engage with the circumferential engagement groove in the handle. This results in an axially fixed and rotatable connection.

German Utility Model No. DE 298 01 858 U1 makes use of radially elastic and hinged support flange sections as the locking mechanism, which are positioned at certain distances along the circumference of an access passage opening in the mounting plate. The individual locking sections are radially spread upon insertion of the handle neck and then engage with the circumferential engagement groove of the handle neck due to their own elasticity. A disadvantage of this approach is that the handle is usually only capable of withstanding low tensile forces. The important capability of withstanding continuous load conditions that many applications require is therefore not provided.

The same applies to a locking mechanism described in European Patent No. EP 0 628 680 B1. That mechanism consists primarily of a guide bushing that is inserted into amounting plate in a force- and form-locking manner and is provided with a leg spring in the section projecting away from the mounting plate. This spring engages tangentially with the circumferential engagement groove of the handle neck using two parallel spring legs in order to invisibly fixate the handle to the mounting plate after the insertion process, though this method also cannot provide a sufficient degree of security.

The locking mechanism of European Patent No. EP 1 022 413 B1 uses a snap ring as the locking means, which is permanently and rotatably mounted on a bushing. After insertion of the handle into the mounting plate, a cylindrical bearing surface within the engagement groove of the handle is non-rotatably surrounded by the snap ring—essentially without any gaps. This solution is problematic with regard to its application as the spreading of the snap ring using the free end of the handle often requires great physical effort.

Another disadvantage of the previously known stop bodies is the fact that they are not capable of keeping the handle mounted on the installation body in a resting position or its initial position or—if the handle has been actuated—to return back to this resting or initial position. However, this is especially required for doors if the locking spring usually present in the mortise lock is not strong enough (or has already worn prematurely due to high loads) to move the handle back to its initial position by itself. This is particularly the case if the handle, which is often angled, is actuated frequently and/or made of a specifically heavy material, such as brass or steel.

It would be desirable to avoid these and other disadvantages presented by the current state of the art and to develop an installation body for doors and/or window handles which is inexpensively constructed with simple means and provides a reliable as well as long-lasting and stable fixation of the handle. An accelerated assembly process on location as well as an improved long-term durability with regard to constantly high loads being exercised on the fitted handles, which should also be quick and easy to disassemble again, if needed, are potential benefits of the invention.

SUMMARY OF THE INVENTION

The main features of the invention in question are stated in Claims 1 and 16, with various embodiments being the subject of Claims 2 to 15 and Claims 17 to 20.

An installation body with an axially fixed and rotatable receptacle for a handle, which is equipped with a circumferential engagement groove around the neck section that comes into contact with the installation body, consisting of the installation body having a base body, which is provided with a passage opening that is centrally positioned with regard to the axis, and a guide bushing for the neck section of the handle, whereas wherein the guide bushing is particularly positioned within the passage opening of the base body as well as a locking mechanism that locks the handle in place inside the base body in such a manner that it can be unlocked again, the invention requires that the locking mechanism is being equipped with guide balls, which are positioned inside the guide bushing in such a manner that they can be shifted radially to the axis while the guide bushing is loaded by a pressure spring in the axial direction, the base body is being provided with a circumferentially inclined surface and the guide balls placed inside the guide bushing are being pushed in the axial direction by the pressure spring in such a way that the guide balls are pushed in a radial direction with regards to the axis with the resulting amount of force.

Such an installation body makes it possible to mount door and window handles to a door in an axially fixed and rotatable manner while also being quick and easy to install. In this regard, it is considered advantageous that it is possible to mount the installation body to a door leaf of the door or on the frame of the window prior to the actual installation of the handle. This kind of preassembly is especially helpful if angled or very large handles are to be installed. The locking mechanism positioned between the installation body and the handle ensures a reliable as well as continuously stable fixation of the handle inside the installation body using the circumferentially arranged locking balls, as since the locking balls are positioned inside the guide bushing in a radially displaceable manner and are pushed against the inclined surface of the base body in the axial direction by the pressure spring. The sloping body directs the force of the pressure spring perpendicular to the axial direction in such a manner that the locking balls are acted upon with the resultant force in the direction of the handle itself. If this handle is positioned inside the guide bushing with its handle neck, the locking balls are pressed into its engagement groove in a force-locking manner, which causes the handle to be fixated inside fixed in the installation body in an axially fixed and rotatable fashion. The locking balls form a strong and stable coupling in combination with the engagement groove of the handle, which is even capable of withstanding heavier and permanent loads.

The assembly of the handle inside the installation body in accordance with the invention is also greatly simplified. When the handle is inserted into the guide bushing, it is pushed slightly in the direction of the pressure spring. This causes the locking balls to disengage from the inclined surface, thereby allowing the balls to radially move outward. The handle can therefore be easily inserted into the installation body. As soon as the handle has reached its final position, the locking balls can engage with the engagement groove of the handle. The pressure spring pushes the locking balls back against the inclined surface of the base body via the guide bushing and thereby radially into the engagement groove. The guide bushing is thereby supported in an axially movable manner over a small travel range within the base body, though it is, particularly in certain sections, positioned inside the passage opening of the base body.

The guide bushing is equipped with a passage opening that is positioned centrally to the axis and is used as a receptacle for the neck section of the handle. The guide bushing is provided with bearing passage openings aligned radially to the axis for the radial storage of the locking balls, while every bearing passage opening preferably has a diameter that is smaller than the diameter of the locking balls at the inner circumference of the passage opening of the guide bushing. This prevents the locking balls from falling inwards if the handle is not yet inserted into the installation body.

To ensure that the locking balls are positioned against the inclined surface of the base body and in the axial direction in an optimal fashion, the thickness of the guide bushing's wall is smaller than the diameter of the locking balls. The latter are thereby positioned opposite the wall of the guide bushing so that the latter is not in the way.

In order to achieve a simplified production of the installation body in accordance with the invention, it is preferable for the guide bushing to be constructed in two parts, such that the bearing passage openings for the locking balls are composed of two halves with one upper section and one lower section of the guide bushing. This allows the locking balls to be easily inserted into the guide bushing, though an automated manufacturing process is also possible, if required.

The upper section of the guide bushing is fitted on top of its lower section with an anti-twist mechanism being provided between the upper and lower sections. This mechanism is composed of a fitted key, which is fixed to the upper section and engages with the lower section in a positive-locking manner when the upper section is in its mounted position. The upper and lower sections are thereby always connected with each other in a rotary-resistant manner without requiring any additional means of connection.

An alternate embodiment of the invention intends for the base body to be constructed from an upper and lower section as well. This also simplifies the manufacturing process of the installation body, especially if the upper section and the lower section of the base body can be assembled in a manner similar to a housing. It is considered expedient in this regard that the circumferential inclined surface is provided on the upper section of the base body while the lower section of the base body contains a receptacle for the guide bushing. The latter is thereby held inside the base body in a reliable and stable manner. In order to reduce the construction height, the lower section of the base body can also be provided with an additional receptacle for the pressure spring.

Another alternate embodiment of the invention provides for the guide bushing of the installation body to be positioned inside the passage opening of the base body in such a manner that it is subjected to the spring force and is rotatably mounted around the axis of the installation body. This not only causes the guide bushing to be mounted on the base body in such a manner that it is allowed to slide along the axis, but also allows it to be rotatable, while the axis of the installation body corresponds to the rotary axis of the handle itself and the spring force ensures that the guide bushing and also the handle are always returned back into the initial position by a rotary motion after every actuation of the handle. For this purpose, the guide bushing contains a spanner flat inside the passage opening, which is equipped with a corresponding counter-surface at the neck section. This causes every rotary motion of the handle to be transferred to the guide bushing and vice-versa. As soon as the person operating the handle lets go of it, the spring force acting upon the guide bushing causes the handle to be returned to its initial position.

The spring force may be, for example, generated by at least one recuperating spring that is supported in the circumferential direction on the base body with its first end, and on the guide bushing with its second end. The recuperating spring thereby supports the often weak springs inside the door locks as a return spring. Such a return spring function is not necessarily required for a window application. The recuperating spring function can in this regard, for example, be provided by a helical compression spring, which generates a spring force in the circumferential direction and is arranged on a pitch circle, if required, in order to use as little space as possible. It is also possible for this function to be provided by a torsion spring or leaf spring.

Yet another advantageous further embodiment provides that the recuperating spring pushes the guide bushing against the stop inside the base body in the circumferential direction. This causes the guide bushing as well as the handle to have a permanently defined initial or resting position. In order to actuate the recuperating spring, the guide bushing is provided with at least one catch while each of these catches forms a thrust bearing for one of the recuperating springs and supports the guide bushing against the stop.

To further stabilize the mounting of the handle inside the installation body and to provide a precise axial stop for the handle, a supporting ring for the handle may be provided on the base body.

For aesthetic reasons, a covering cap may be attached to the base body, which can, for example, be engaged with the base body and which serves to cover it up.

DESCRIPTION OF THE DRAWINGS

Other features, characteristics, and advantages of the invention result from the wording of the claims as well as the following description of embodiment examples (examples of further development) based on the enclosed in which:

DETAILED DESCRIPTION OF THE PREFERRED EMBODIMENT

Figure 1:
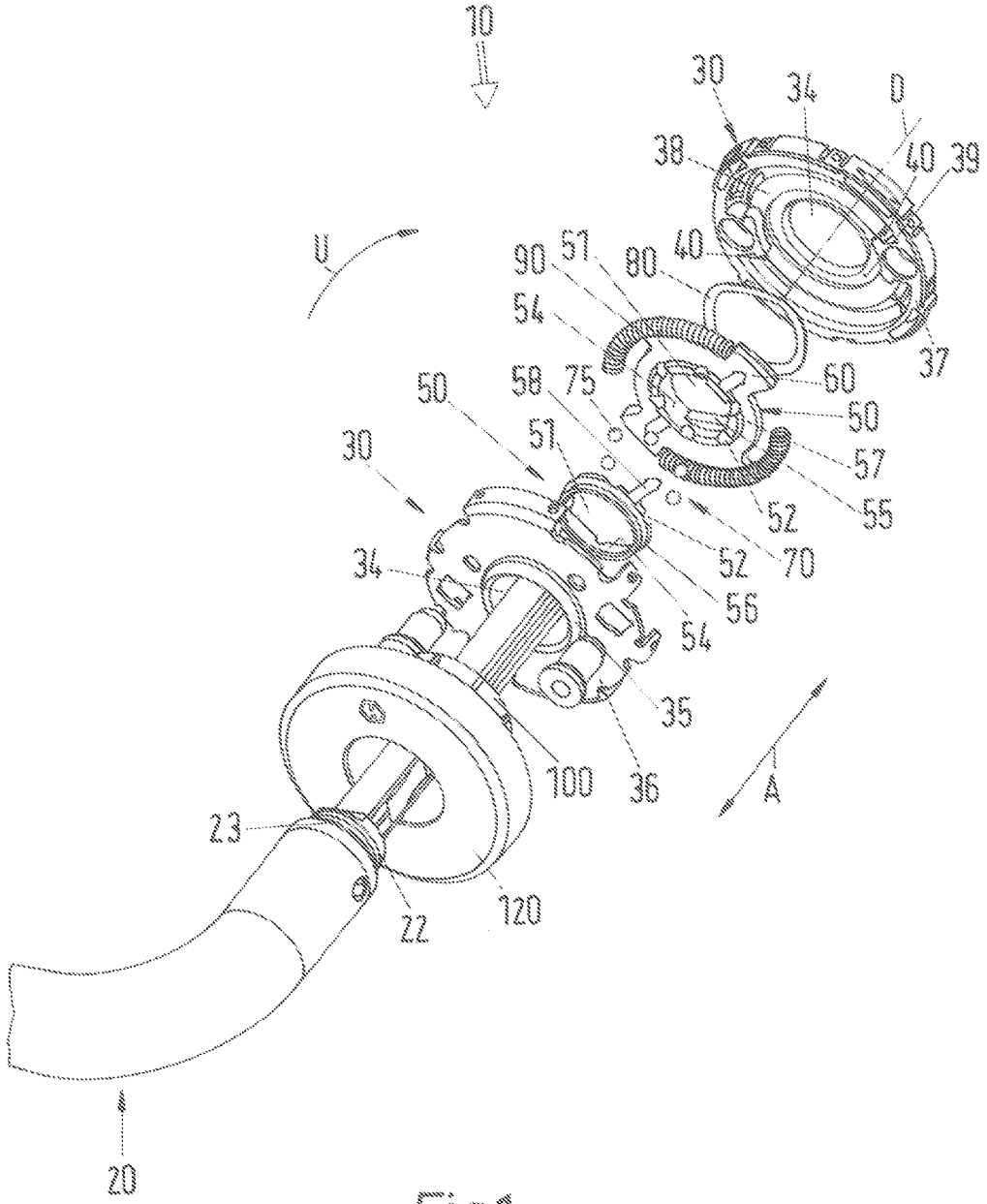
FIG. 1 shows an exploded representation of the components of an installation body with handle and square spindle.

The installation body identified as 10 in FIG. 1 comprises a base body 30 and a guide bushing 50. The base body, in turn, encompasses an upper section 36 and a lower section 37, between which a space is provided for the guide bushing 50. After assembling the upper section 36 and lower section 37, the guide bushing 50 is inserted into the base body. In this context, it is possible to provide a receptacle 38 for the guide bushing 50 inside the lower section 37 of the base body 30 that can simultaneously serve as a means to secure radial positioning.

The installation body 10 is used as an axially fixed and rotatable receptacle for a handle 20, with the handle 20 being provided with a circumferential engagement groove 23 in a neck section 22 that is in contact with the installation body 10. The base body 30 of the installation body 10 is provided with a passage opening 34 centrally to the "D" axis. The guide bushing 50 that is centrally arranged with regard to the passage opening 34 inside the base body 30 is composed of a passage opening 51 that is flush with the other passage opening 34 through which the neck section 22 of the handle 20 and therefore a typically connected square spindle can be guided.

A support ring 100 for the handle 20 is provided on the base body 30 through which the mounted handle 20 is axially supported on the installation body 10. This achieves a high degree of stability.

A covering cap 120 can be attached to the base body 30, which then engages with the base body 30. This results in a smooth, easy to clean, and highly aesthetically pleasing surface and allows for the protection of the base body 30 as well as protecting all of the mechanical elements contained therein from environmental influences.

The handle 20 is fixated in the base body 30 using a locking mechanism 70 from where it can also be unlocked again. The locking mechanism 70 preferably comprises a number of locking balls 75 that are arranged inside the guide bushing 50 and can be displaced radially in the direction of the "D" axis, and can thereby engage with the engagement groove 23 of the neck section 22. In this regard, the locking balls 75 are radially and flexibly mounted in bearing passage openings 52 of the guide bushing 50 that are radially aligned with the "D" axis. The guide bushing 50 is mounted concentrically to the passage opening 34 inside the base body 30 and can be moved in the axial direction "A", wherein a pressure spring 80 imparts a force on the guide bushing 50 from the direction of the upper section 36 and/or the handle 20 and in the axial direction "A". The lower section 37 of the base body 30 contains a receptacle 39 for the pressure spring 80.

The base body 30 is provided with a circumferential inclined surface 35, which concentrically surrounds the passage opening 34. The locking balls 75 that are mounted inside the guide bushing 50 are pressed against the inclined surface 35 by the pressure of the pressure spring 80 in the axial direction "A" in such a manner that a resulting force "F" is radially applied to the locking balls 75 in the direction of axis "D" and with the locking balls 75 thereby being inclined to move inwardly in a radial motion. Accordingly, they automatically engage with the engagement groove 23 formed in the neck section 22 of the handle 20 after insertion of the neck section 22 of the handle 20.

Upon insertion of the handle 20, the guide bushing 50 is forced away from the inclined surface 35 and against the pressure spring 80 force by the contact between the neck section 22 and the locking balls 75 so that the locking balls 75 can radially escape outward and it is thereby possible to insert the neck section 22 with very little force.

In order to loosen the handle 20 from the installation body 10, a pointed object, such as a screwdriver, can be put through the passage openings of the upper section 36 of the base body 30 to exert an axial force on the guide bushing 50 and against the pressure spring 80 force, so that the guide bushing 50 is moved away from the inclined surface 35, thereby allowing for radial movement of the engagement grooves 75 to the outside. This allows the engagement grooves 75 to be taken out of engagement with the engagement groove 23 and allows the handle 20 to be removed.

The guide bushing 50 is composed of two parts with a circular upper section 56 and a circular lower section 57, which can be connected in a form-fitting and thereby rotationally fixed manner. An anti-twist protection is provided by fitted keys 58 that radially protrude to the outside from the upper section 56 and engage with the corresponding recesses in the lower section 57 in a positive-locking manner. The bearing passage openings 52 are in equal parts designed as semi-circular recesses inside the upper section 56 and the lower section 57 whereas the bearing passage openings 52 are continuous, meaning that they lead to the inner circumference 54 of the passage opening 51. In order to prevent the engagement grooves 75 from falling out of the bearing passage openings 52, the diameter of the bearing passage openings 52 on an inner end that is opposed to the passage opening is reduced to a diameter "V", which is smaller than the diameter "W" of the engagement grooves 75. A corresponding reduction in diameter can, if required, also be formed radially on the outer end, so that the engagement grooves 75 are stored safely inside the bearing passage openings 52 like in a bearing cage.

The wall thickness "T" of the guide bushing 50, particularly of the upper section 56, is smaller than the diameter "W" of the locking balls 75. This allows the locking balls 75 to freely come into contact with the inclined surface 35 and thereby results in them being pushed radially inside the bearing passage openings 52.

A special embodiment of this installation body 10 intends that the guide bushing 50 within the passage opening 34 of the base body 30 is also mounted rotatably around the axis "D" against a spring force. For this purpose, the guide bushing 50 is provided with a spanner flat 55 for the handle 20 within the passage opening 51, through the use of which a rotary movement of the handle 20 and/or the connected square spindle can be transferred to the guide bushing 50. A corresponding surface is formed particularly on the neck section 22, which is assigned to the key spring with the handle 20 mounted and thereby allows for a torque transmission between the handle 20 and guide bushing 50. The neck section 22 is then held inside the passage opening 51 of the guide bushing 50 in a positive-locking manner.

The spring force is generated by at least one recuperating spring 90 that is supported in the circumferential direction "U" on the base body 30 with its first end 92, and on the guide bushing 50 with its second end 94. This causes each recuperating spring 90 to be pushed against a stop 40 in the base body 30 in the circumferential direction "U" by the guide bushing 50. To this end, the guide bushing 50 is provided with at least one driver 60, whereas each driver 60 forms a thrust bearing for one of the recuperating springs 90 and supports the guide bushing 50 against the stop 40.

The return spring can be used in both rotary directions, meaning for both right-hand as well as left-hand rotations. This allows the installation body to be used in various applications. The spring function is only activated upon actuation of the handle so that the return spring is unloaded if the handle is in its initial position. Such a return spring allows for the commonly used recuperating springs of the door lock mechanism to be relieved.

Figure 2:
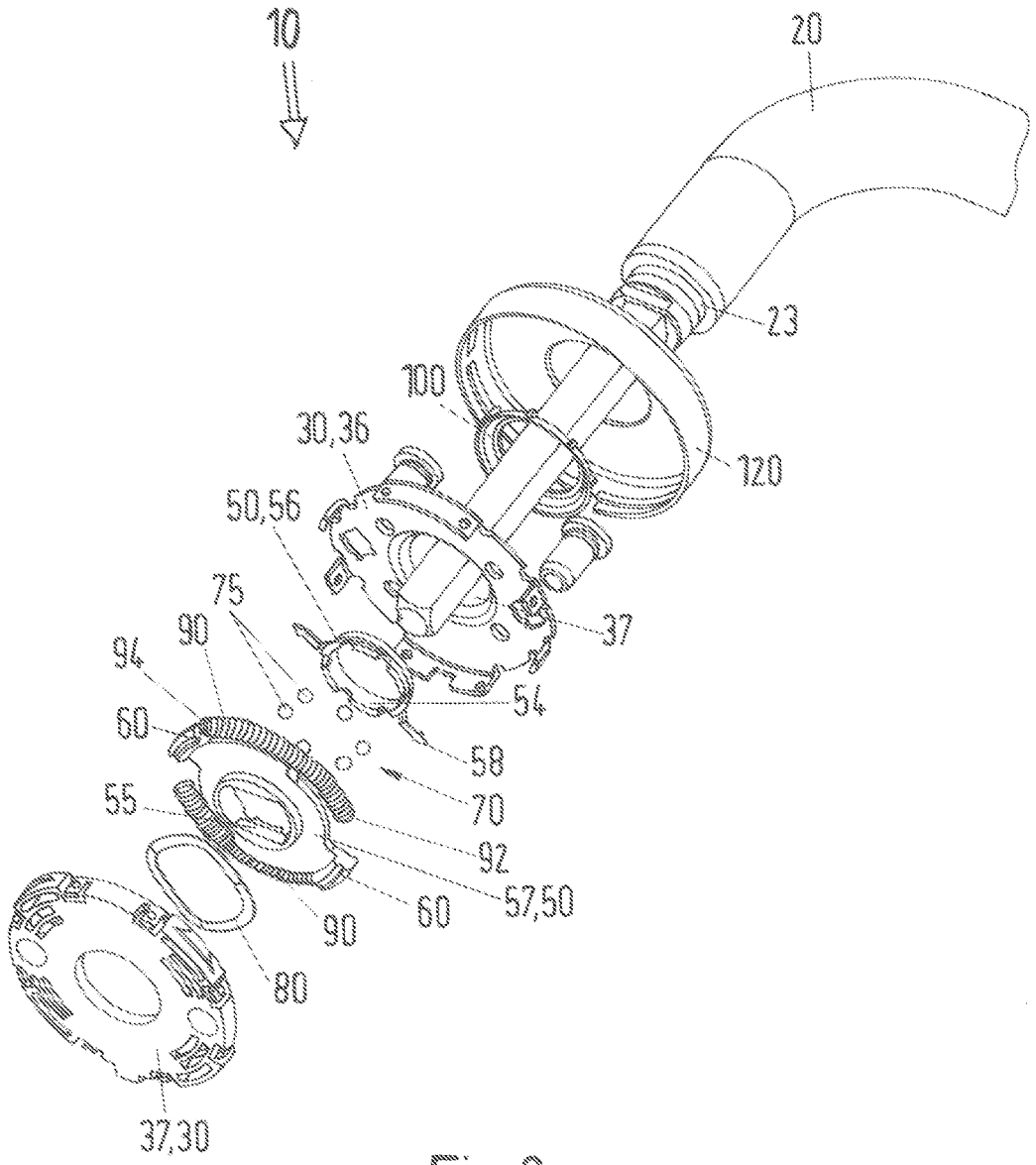
FIG. 2 shows an exploded representation of FIG. 1 from a different perspective.

FIG. 2 shows the installation body 10 and the handle 20 from an opposite perspective compared to FIG. 1. The same elements are identified by the same reference signs. It can be seen that the support ring 100 has a conical inner surface, so that it is in contact with a correspondingly formed upper side of the upper section 36 in the area of the inclined surface 35 in the installed state. A suitable construction is provided on the underside of the lower section 37 to provide a firm hold, particularly with regard to the surface of a door leaf. Furthermore, passage openings for the placement of fixing screws are provided in the lower section 37 in order to fixate the lower section 37 and thereby the installation body 10 accordingly.

Figure 3:
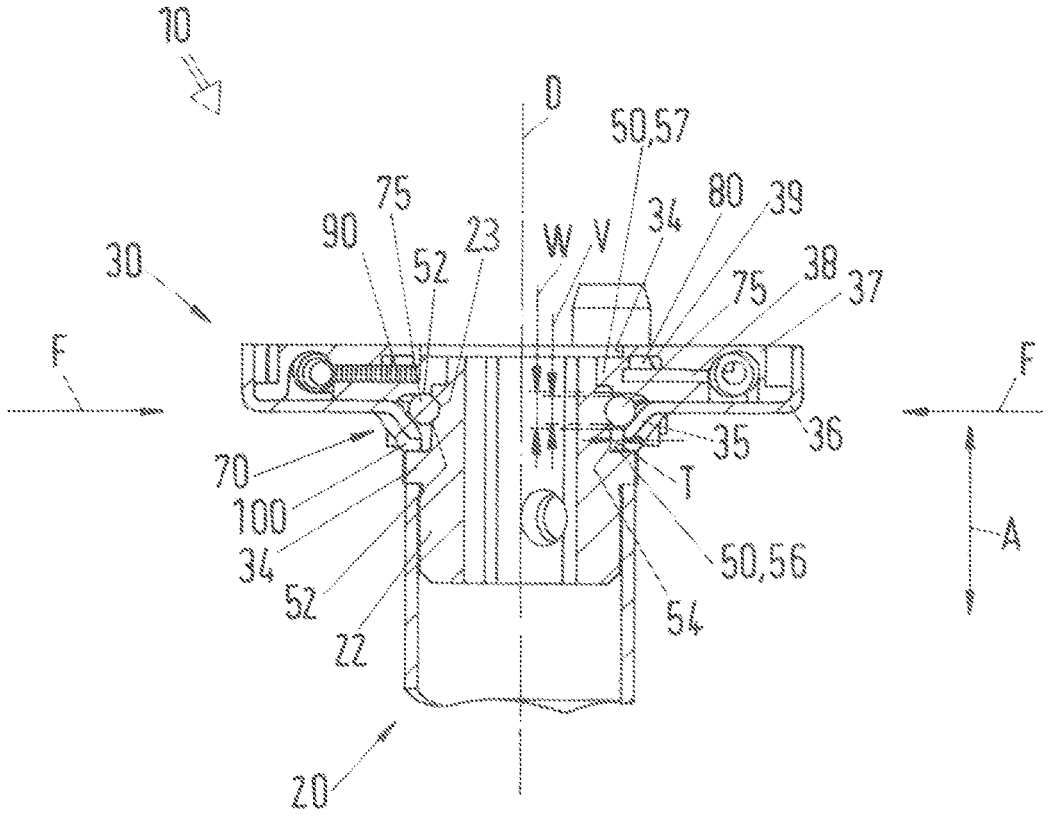
FIG. 3 shows a cross-sectional representation of FIG. 1 with the handle mounted.

FIG. 3 shows a cross-sectional representation of the installation body 10 with the neck section 22 of the handle 20 inserted. The guide bushing 50 is axially pressed against the inclined surface 35 by the pressure spring 80, which caused the locking balls to be radially moved inside and partially engage the engagement groove 23. An axial withdrawal of the handle 20 is thereby prevented by the locking balls 75 by means of a positive-locking fit. These thereby represent a blocking body.

The invention is not limited to the embodiments and developments detailed above, but can be modified in many ways. For example, a variant with six locking balls 75 is shown, which are positioned inside bearing passage openings 51, which are located inside the guide bushing 50 next to each other at equal intervals in the circumferential direction. But a different number of locking balls 75 would also be possible. It would also be possible to select a different geometric form instead of locking balls to realize this blocking body. Different variants for the recuperating spring are also conceivable.

All characteristics, features and advantages arising from the claims, the description and the drawings, including any constructive details, spatial arrangements and process steps can be crucial to the invention by themselves as well as in various different combinations.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be claimed alone or in combination with any of the features, elements, or components of any of the other embodiments discussed above.

| List of Reference Signs | |
|---|---|
| A | Axial direction |
| D | Axis |
| F | Force |
| T | Wall thickness (guide bushing) |
| U | Circumferential direction |
| V | Diameter (bearing passage opening) |
| W | Diameter (locking ball) |
| 10 | Installation body |
| 20 | Handle |
| 22 | Neck section |
| 23 | Engagement groove |
| 30 | Base body |
| 34 | Passage opening |
| 35 | Inclined surface |
| 36 | Upper section |
| 37 | Lower section |
| 38 | Receptacle |
| 39 | Receptacle |
| 40 | Stop |
| 50 | Guide bushing |
| 51 | Passage opening |
| 52 | Bearing passage opening |
| 54 | Inner circumference |
| 55 | Spanner flat |
| 56 | Upper section |
| 57 | Lower section |
| 58 | Fitted key |
| 60 | Driver |
| 70 | Locking mechanism |
| 75 | Locking ball |
| 80 | Pressure spring |
| 90 | Recuperating spring |
| 92 | First end |
| 94 | Second end |
| 100 | Support ring |
| 120 | Cover cap |

What is claimed is:

1. An installation body for use as an axially fixed and rotatable receptacle for a handle, the handle having a circumferential engagement groove located in a neck section of the handle that is for contact engagement with the installation body, the installation body comprising:

a) a base body that is provided with a passage opening centrally aligned with an axis (D); and b) a guide bushing for the neck section of the handle; and c) a locking mechanism, for releasably fixing the handle in the base body;

d) wherein the locking mechanism uses locking balls that are adjustable and are arranged radially in the direction of the axis (D) inside the guide bushing; and e) wherein the guide bushing is positioned inside the base body in an axial direction (A) in an adjustable manner, wherein the guide bushing is acted upon by a pressure spring in the axial direction (A); and f) wherein the base body is provided with a circumferential inclined surface; and g) wherein the locking balls located inside guide bushing are pushed against the inclined surface in the axial direction (A) by the pressure spring in such a manner that a resulting force (F) is radially imparted upon the locking balls in the direction of the axis (D).

2. The installation body as defined in claim 1, wherein the guide bushing comprises a passage opening for the neck section of the handle centrally to the axis (D).

3. The installation body as defined in claim 2, wherein the guide bushing comprises bearing passage openings that are aligned radially to the axis (D).

4. The installation body as defined in claim 3, wherein every bearing passage opening on an inner circumference of the passage opening of the guide bushing has a diameter (V) that is smaller than a diameter (W) of the locking balls.

5. The installation body as defined in claim 4, wherein a wall thickness (T) of the guide bushing is smaller than the diameter (W) of the locking balls.

6. The installation body as defined in claim 5, wherein the guide bushing consists of two parts with the bearing passage openings for the locking balls are each divided into two halves, one upper section and one lower section of the guide bushing.

7. The installation body as defined in claim 6, wherein the upper section of the guide bushing is positioned on the lower section with an anti-twist mechanism being located between the upper section and the lower section.

8. The installation body as defined in claim 7, wherein the base body comprises an upper section and a lower section.

9. The installation body as defined in claim 8, wherein the circumferential inclined surface is positioned on the upper section of the base body.

10. The installation body as defined in claim 9, wherein the lower section of the base body has a receptacle for the guide bushing located therein.

11. The installation body as defined in claim 10, wherein guide bushing is rotatably mounted around the axis (D) against the spring force in a manner that is concentric to the passage opening of the base body.

12. The installation body as defined in claim 11, wherein the guide bushing forms a spanner flat for the handle within the passage opening.

13. The installation body as defined in claim 12, wherein the spring force is generated by at least one recuperating spring that is supported in the circumferential direction (U) on the base body with its first end and on the guide bushing with its second end.

14. The installation body as defined in claim 13, wherein recuperating spring presses the guide bushing against a stop in the base body in the circumferential direction (U).

15. The installation body as defined in claim 14, wherein the guide bushing is provided with at least one driver, and wherein each driver forms a thrust bearing for one of the recuperating springs and supports the guide bushing against the stop.

16. An installation body with an axially fixed and rotatable receptacle for removably receiving a handle, the handle being equipped with a circumferential engagement groove around a neck section thereof for engagement with the installation body, the installation body comprising:

a base body having a passage opening therein which is centrally located with respect to an axis, the base body having a circumferentially inclined surface located therein;

a guide bushing for the neck section of the handle, the guide bushing normally being positioned within the passage opening of the base body; and a locking mechanism for releasably locking the handle in place with the neck of the handle located inside the base body, the locking mechanism comprising:

a plurality of locking balls positioned inside the guide bushing in such a manner that they can be shifted radially with respect to the axis; and a pressure spring arranged to load the guide bushing in the axial direction, whereby the locking balls located inside the guide bushing are urged in the axial direction by the pressure spring causing the locking balls to be pushed against the inclined surface and move in a radially inward direction with regards to the axis to engage the circumferential engagement groove in the neck section of the handle when the neck section of the handle is inserted into the base body.

17. The installation body as defined in claim 16, wherein the locking mechanism is arranged such that when the neck section of the handle is inserted into the base body, the guide bushing is pushed in the direction of the pressure spring in a manner causing the locking balls to disengage from the inclined surface and move radially outwardly, thereby allowing the neck section of the handle to be easily inserted into the installation body.

18. The installation body as defined in claim 17, wherein the guide bushing comprises a plurality of bearing passages aligned radially with respect to the axis, each bearing passage for the radial storage of a respective one of the locking balls, each bearing passage having an opening with a diameter that is smaller than the diameter of the locking balls at the inner extent of such bearing passage to prevent the locking ball in such bearing passage from falling inwards out of the bearing passage if the neck section of the handle has not yet been inserted into the installation body.

19. The installation body as defined in claim 18, wherein the guide bushing comprises two mating sections with an anti-twist mechanism being provided therebetween which is arranged such that once the two mating sections of the guide bushing are connected together, they will remain connected together in a rotation-resistant manner, wherein the bearing passages for the locking balls comprise two halves respectively located in the two mating sections of the guide bushing.

20. The installation body as defined in claim 16, wherein the guide bushing is rotatable with the handle, the installation body additionally comprising:

a recuperating spring arranged to cause the guide bushing and a handle having its neck engaged with the guide bushing to returned into an initial position after any rotary actuation of the handle.

* * * * *